US007137323B1

(12) United States Patent
Hsieh

(10) Patent No.: US 7,137,323 B1
(45) Date of Patent: Nov. 21, 2006

(54) REPLACEABLE AND ROTATABLE TOOL WITH FUNCTION OF MEASURING TWISTING FORCES

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/200,718

(22) Filed: Aug. 11, 2005

(51) Int. Cl.
*B25B 23/14* (2006.01)
*B25B 23/159* (2006.01)

(52) U.S. Cl. ..... 81/467; 81/481; 81/483

(58) Field of Classification Search ..... 81/467, 81/481, 483, 480, 470, 177, 177.6, 177.7; 433/141, 173, 174
See application file for complete search history.

(56) References Cited

U.S. PATENT DOCUMENTS 2,608,894 A * 9/1952 Miller, Jr. et al. ..... 81/177.9
5,331,869 A * 7/1994 Webb ..... 81/177.1
5,660,491 A * 8/1997 Roberts et al. ..... 403/74
5,860,337 A * 1/1999 Janssen ..... 81/63
6,189,420 B1 * 2/2001 Shiao ..... 81/60
6,220,125 B1 * 4/2001 Lan ..... 81/177.9
6,339,979 B1 * 1/2002 Chiang ..... 81/177.2
6,386,075 B1 * 5/2002 Shiao ..... 81/177.8
6,796,190 B1 * 9/2004 Curry ..... 73/862.21
6,848,345 B1 * 2/2005 Lin ..... 81/177.8
6,895,839 B1 * 5/2005 Hsien ..... 81/177.8
6,928,903 B1 * 8/2005 Liao ..... 81/58.3

* cited by examiner

*Primary Examiner*—Lee D. Wilson
*Assistant Examiner*—Alvin J Grant

(57) ABSTRACT

A replaceable and rotatable tool with a function of measuring twisting forces comprises a tool body; a driving portion formed at one end of the tool body; the driving portion including a pivotal unit and an engaging unit; one end of the pivotal unit being secured to the tool body and another end thereof being pivotally installed with one end of the engaging unit so that the engaging unit being rotatable along the pivotal shaft; another end of the engaging unit being formed with an opening for movably installing various driving head. The pivotal unit is formed with at least one inclined surface for controlling the slope of the engaging unit with respect to the axis of the handle. The angle of the engaging unit with respect to the axis of the handle is retained within a range of 15 degrees in each of two rotating directions.

2 Claims, 5 Drawing Sheets

REPLACEABLE AND ROTATABLE TOOL WITH FUNCTION OF MEASURING TWISTING FORCES

FIELD OF THE INVENTION

The present invention relates to hand tools, and particularly to a replaceable and rotatable tool with a function of measuring twisting forces, wherein the orientation of the driving end of the tool is adjustable with respect to the handle of the tool so that the tool is suitable for various operation environments. Thereby the different driving ends are replaceable. Furthermore, the tool is equipped with strain gauges to measure the twisting force applied to the tool.

BACKGROUND OF THE INVENTION

Currently, many tools are equipped with strain gauges for measuring the twisting forces applied to the tool. Thereby the user can view the value of the strain gauge to decide the force applied to the tool. Thus the screw can be driven properly without breakage.

In the prior art, strain gauge spanner has the function of the measuring twisting force, but the driving end of the spanner has a fixed type. The diving end is not replaceable. Thereby when users desire to drive screws of different sizes, the user must buy another spanner with the strain gauge. One spanner has respective strain gauges. This induces a high cost. Furthermore, it is often that the user has no desire to buy a strain gauge tool due the finite use thereof. Only the old form spanners are used.

Furthermore, the orientation of the driving end of the spanner with respect to the handle of the spanner is always in a fixed angle. Thereby in some places not suitable for the orientation of the driving end, the user will feel uneasy in operation.

SUMMARY OF THE INVENTION

Accordingly, the primary object of the present invention is to provide a replaceable and rotatable tool with a function of measuring twisting forces, wherein the orientation of the driving end of the tool is adjustable with respect to the handle of the tool so that the tool is suitable for various conditions. Thereby the different driving ends are replaceable. Furthermore, the tool is equipped with strain gauges to measure the twisting force applied to the tool.

To achieve above objects, the present invention provides a replaceable and rotatable tool with a function of measuring twisting forces. The tool comprises a spanner body; a driving portion formed at one end of the spanner body; the driving portion including a pivotal unit and an engaging unit; one end of the pivotal unit being secured to the spanner body and another end thereof being pivotally installed with one end of the engaging unit so that the engaging unit is rotatable along the pivotal shaft; another end of the engaging unit being formed with an opening for movably installing various driving heads. The pivotal unit is formed with at least one inclined surface for controlling the slope of the engaging unit with respect to the axis of the handle. The angle of the engaging unit with respect to the axis of the handle is retained within a range of 15 degrees in each of two rotating directions.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be made in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
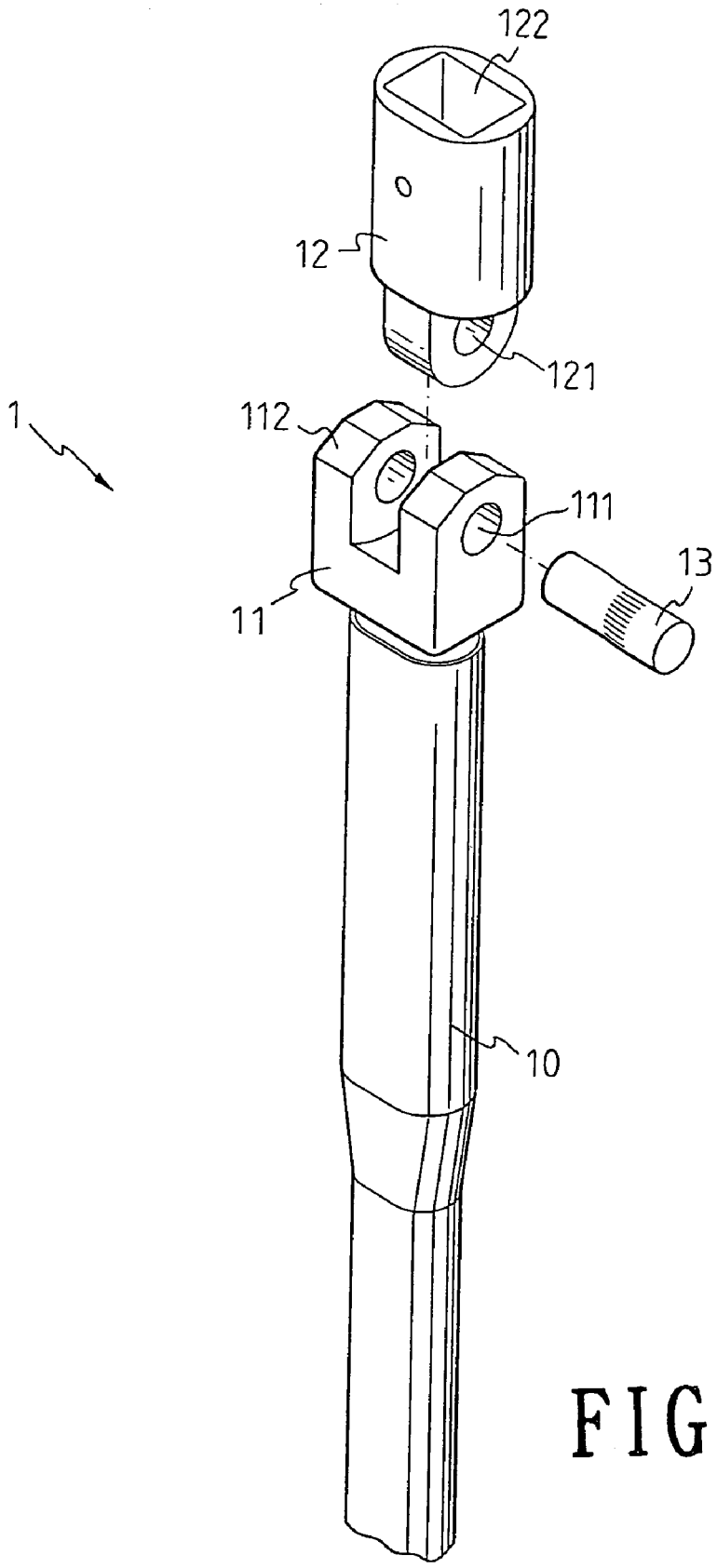
FIG. 1 is an exploded perspective view of the replaceable and rotatable tool with a function of measuring twisting forces of the present invention.
Figure 2:
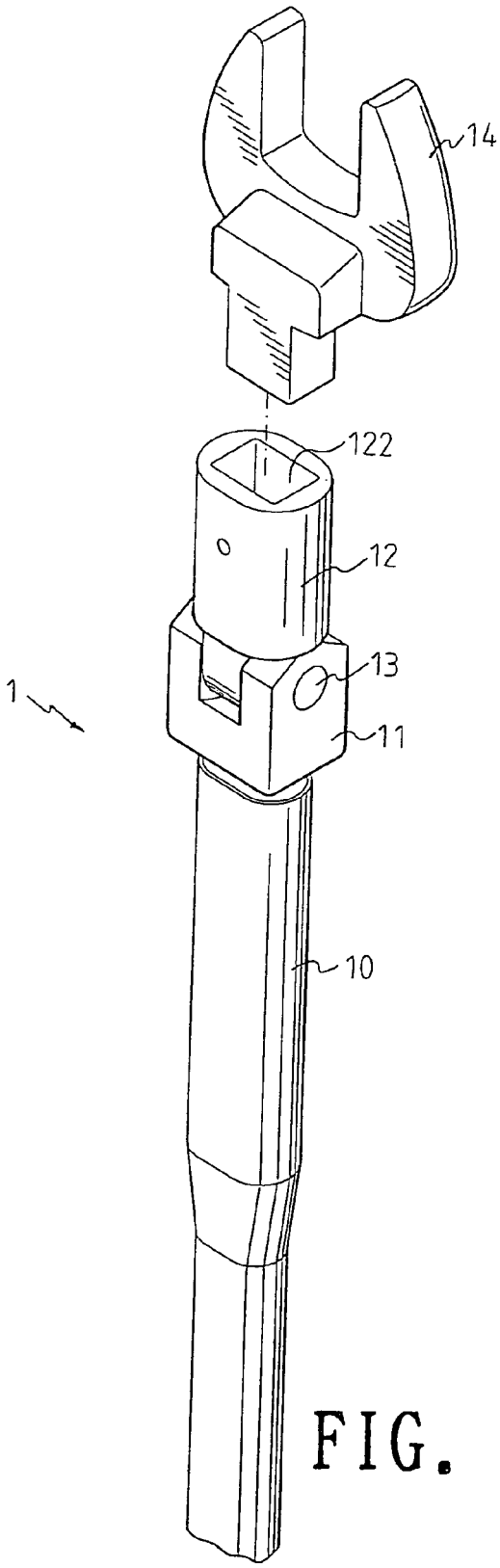
FIG. 2 is a lateral view of the replaceable and rotatable tool with a function of measuring twisting forces of the present invention.
Figure 3:
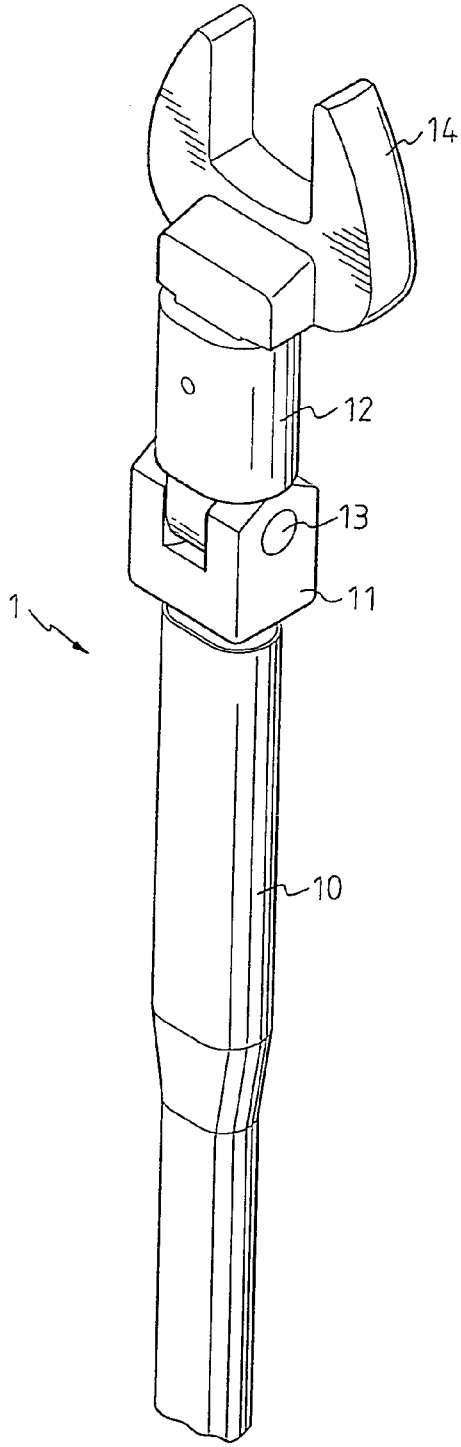
FIG. 3 shows the operation of the replaceable and rotatable tool with a function of measuring twisting forces of the present invention.
Figure 4:
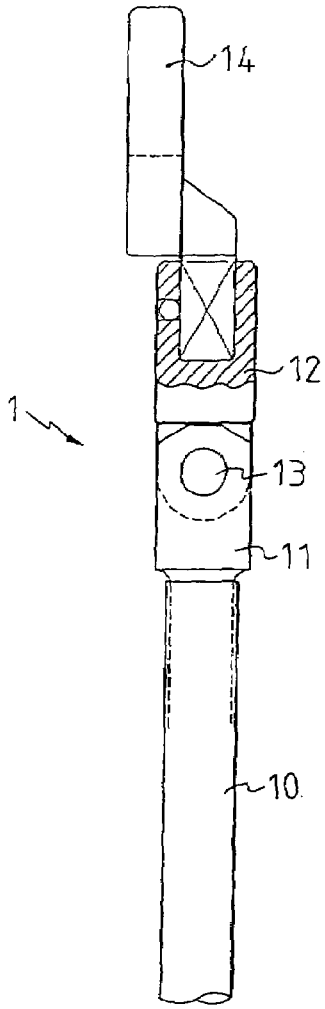
FIG. 4 is a schematic view showing the replacement of the driving head according to the present invention.
Figure 5:
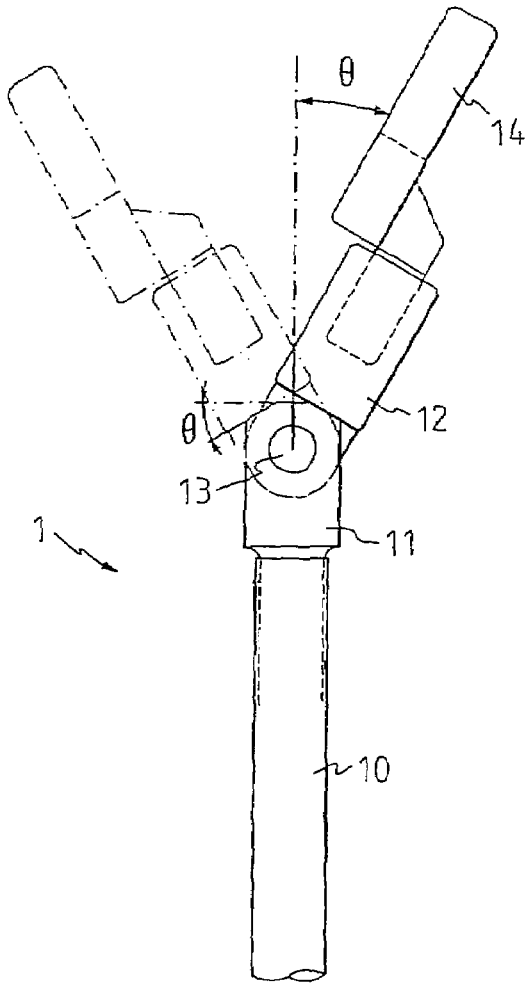
FIG. 5 is a schematic view showing the operation of the present invention.
Figure 6:
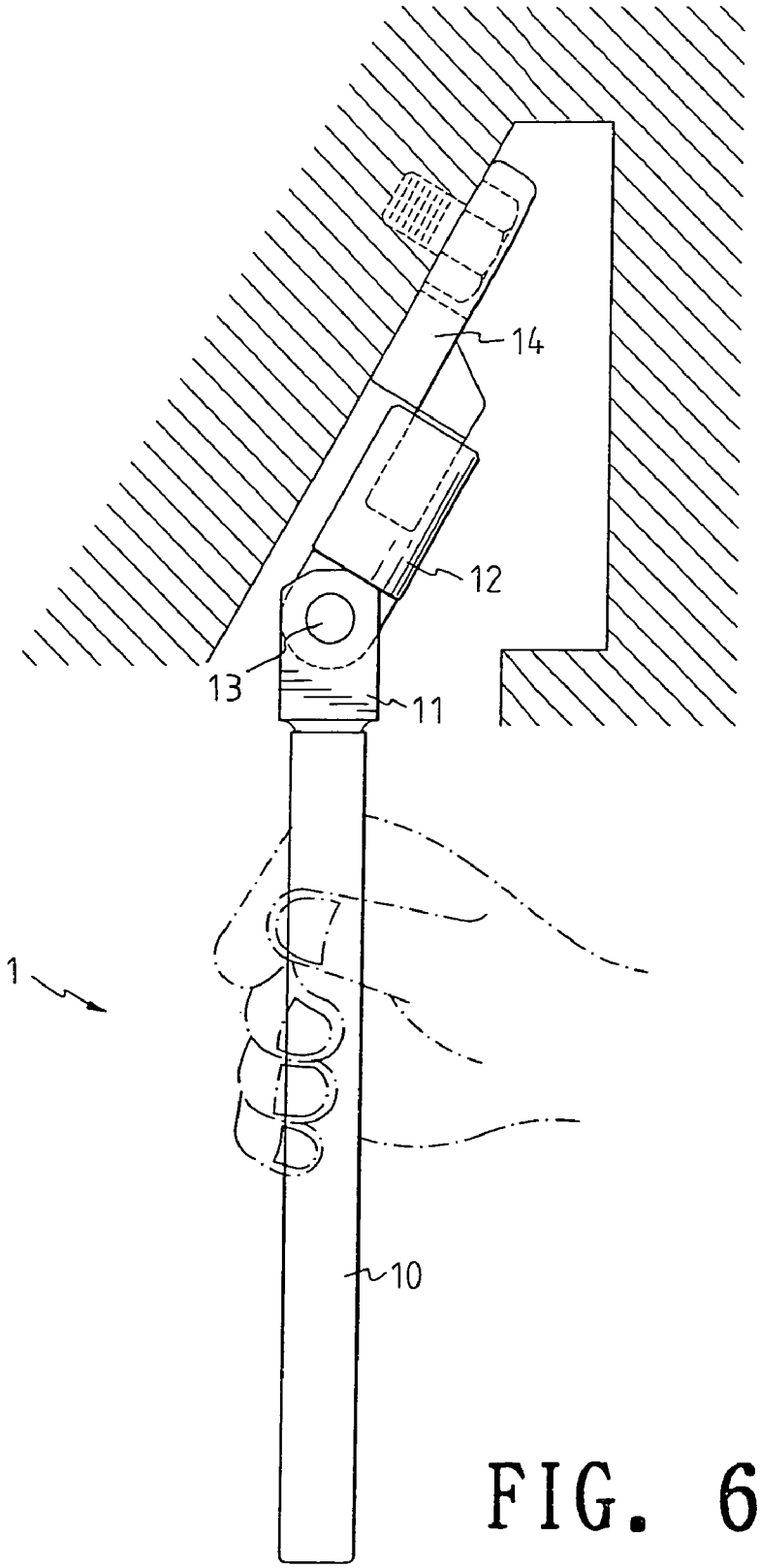
FIG. 6 is a schematic view showing the use of the present invention.
Figure 7:
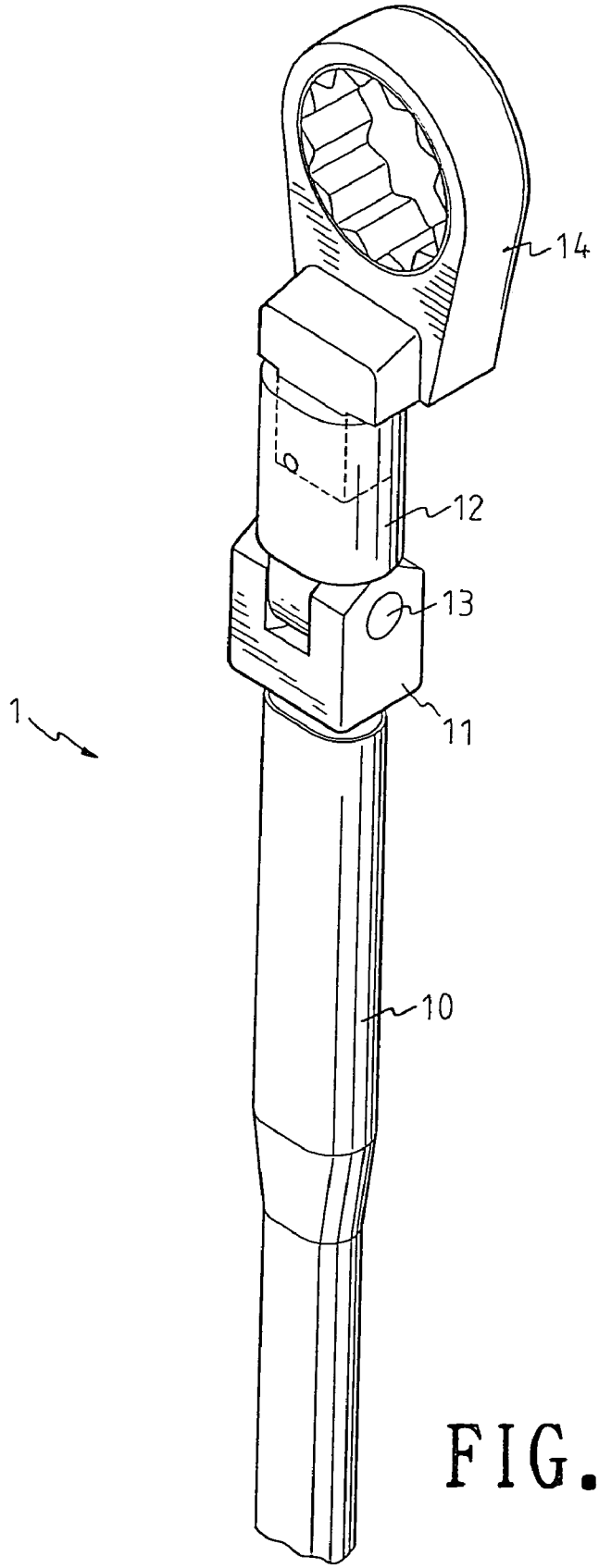
FIG. 7 is a schematic view showing the replacement of the driving head according to the present invention.

Referring to FIGS. 1 to 3, the present invention is illustrated. The present invention includes the following elements.

A spanner body 1 may be installed with a strain gauge (not shown) for displaying twisting forces as the spanner drives a screw. However this is known in the prior art and thus the detail will not be further described.

A handle 10 is formed at another end of the spanner body 1.

A driving portion is formed at one end of the spanner body 1. The driving portion includes a pivotal unit 11 and an engaging unit 12. One end of the pivotal unit 11 is secured to the spanner body 1 and another end thereof is formed with at least one pivotal hole 111. The pivotal unit 11 is formed with at least one inclined surface 112 for controlling the slope of the engaging unit 12 with respect to the axis of the handle 10. Thus, the angle of the engaging unit 12 with respect to the axis of the handle 10 is retained within a range 15 degrees in each of two rotating directions so as to prevent that the screw from rotation. This is because the engaging unit 12 with respect to the axis of the handle has a great angle. A distal end of the engaging unit 12 has a through hole 121 corresponding to the pivotal holes 111 of the pivotal unit 11. A pivotal shaft 13 passes through the two pivotal holes 111 and the through hole 121 so as to fix the engaging unit 12 to the pivotal unit 11. Then the engaging unit 12 is rotatable along the pivotal shaft 13. Another end of the engaging unit 12 is formed with an opening 122 for movably installing various driving head 14. A positioning unit (not shown) is installed within the opening 122. The positioning unit is formed by a steel ball and a spring to achieve the effect of driving the driving head 14. This is known in the prior art and the thus the detail will not be further described. When the driving head 14 is received within the opening 14.

The positioning unit will secure the driving head 14 so as to prevent the driving head 14 separating from the positioning unit during operation.

In use of the present invention, referring to FIGS. 4 to 7, a driving head 14 is received into the opening 122 at a front end of the engaging unit 12. The positioning unit fixes the driving head 14 so as to combine the driving head 14 to the engaging unit 12. A screw element is combined with the driving head 14. The handle 10 is held. In driving the driving head 14, the engaging unit 12 is pivotally installed to the pivotal unit 11. The engaging unit 12 is rotatable with respect to the axis of the handle 10 within a small angle to avoid some obstacle so as to drive the screw element easily. A twisting force in operation can be measured in operation. When a different driving head 14 is necessary, the driving head 14 can be taken out from the opening 122, and a proper driving head 14 is installed into the opening 122 of the engaging unit 12. Thereby the spanner can be used again with the function of measuring twisting force.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A replaceable and rotatable tool with a function of measuring twisting forces comprising:

a tool body;

a driving portion formed at one end of the tool body; the driving portion including a pivotal unit and an engaging unit; one end of the pivotal unit being secured to the tool body and another end thereof being pivotally installed with one end of the engaging unit so that the engaging unit is rotatable along a pivotal shaft; another end of the engaging unit being formed with a rectangular opening for movably installing various driving head;

wherein a positioning unit is installed within the opening; the positioning unit is formed by a steel ball and a spring for driving the driving head;

wherein the tool body has a strain gage installed therein for displaying twisting forces as the tool drives a screw;

wherein the pivotal unit has two lateral sides; an upper portion of each lateral side is formed with one flat surface and two arcuate surfaces at two sides of the flat surface for controlling the slope of the engaging unit with respect to the axis of the handle;

wherein the angle of the engaging unit with respect to the axis of the handle is retained within a range of 15 degrees in each of two rotating directions; and wherein each of the two lateral sides of the pivotal unit is formed with at least one pivotal hole; a distal end of the engaging unit having a through hole corresponding to the pivotal hole of the pivotal unit; a pivotal shaft passing through the pivotal hole and the through hole so as to fix the engaging unit to the pivotal unit.

2. The replaceable and rotatable tool with a function of measuring twisting forces as claimed in claim 1, further comprising:

a T shape supporter; a leg of the T shape supporter having a rectangular shape and being insertable into the rectangular opening; and a spanner head with an opening end for driving a working piece.

* * * * *